US009334862B2

(12) United States Patent
Miyaki

(10) Patent No.: US 9,334,862 B2
(45) Date of Patent: May 10, 2016

(54) ELECTRIC OIL PUMP WITH DISCHARGE PRESSURE STABILIZATION

(75) Inventor: Junichi Miyaki, Anjo (JP)

(73) Assignee: JTEKT CORPORATION, Osaka-shi (JP)

( * ) Notice: Subject to any disclaimer, the term of this patent is extended or adjusted under 35 U.S.C. 154(b) by 357 days.

(21) Appl. No.: 13/606,646

(22) Filed: Sep. 7, 2012

(65) Prior Publication Data

US 2013/0071267 A1 Mar. 21, 2013

(30) Foreign Application Priority Data

Sep. 17, 2011 (JP) ..... 2011-203885

(51) Int. Cl.
*F04C 2/10* (2006.01)
*F04B 39/14* (2006.01)
*F04C 11/00* (2006.01)

(52) U.S. Cl.
CPC . *F04C 2/10* (2013.01); *F04B 39/14* (2013.01); *F04C 11/008* (2013.01); *F04C 2210/206* (2013.01); *F04C 2230/60* (2013.01); *F04C 2240/30* (2013.01); *F04C 2240/40* (2013.01); *F04C 2240/805* (2013.01)

(58) Field of Classification Search
CPC .. F04C 15/008; F04C 11/008; F04C 2230/60; F04C 2/10; F04C 2240/40; F04C 2210/206; F04C 2240/805; F04B 17/03; F04B 53/16; F04B 53/22; F04D 29/406; F04D 29/60; F04D 29/605
USPC ..... 417/410.1, 410.3, 423.7, 423.14, 360, 417/363; 418/360, 363
See application file for complete search history.

(56) References Cited

U.S. PATENT DOCUMENTS 3,779,674 A * 12/1973 Eckerle et al. ..... 418/71
6,499,970 B1 * 12/2002 Siegel ..... B60T 8/3685 417/360
2007/0052310 A1 * 3/2007 Sakai et al. ..... 310/87
2008/0145259 A1 * 6/2008 Nakakuki et al. ..... 418/109
2009/0175751 A1 * 7/2009 Nakayoshi ..... 418/171
2010/0111731 A1 * 5/2010 Suzuki et al. ..... 417/423.7

FOREIGN PATENT DOCUMENTS

EP 1566545 A2 8/2005
JP 2003-129966 A 5/2003
JP A-2005-098268 4/2005

OTHER PUBLICATIONS

Mar. 11, 2016 Search Report issued in European Patent Application No. 12183719.9.

* cited by examiner

*Primary Examiner* — Justin Jonaitis
*Assistant Examiner* — Stephen Mick
(74) *Attorney, Agent, or Firm* — Oliff PLC

(57) ABSTRACT

A pump housing of a gear pump and a stator of an electric motor are fastened to each other with bolts via a front insulator. Dowel pins are inserted in respective through-holes that are formed in the front insulator at equal intervals in a circumferential direction so as to be located next to insertion holes for the bolts. Respective end portions of each dowel pin are in contact with a bottom face of the pump housing and a pump-side surface of the stator core, and the pump housing and the front insulator are fixed to each other such that a slight gap is formed between the pump housing and the front insulator.

12 Claims, 3 Drawing Sheets

ELECTRIC OIL PUMP WITH DISCHARGE PRESSURE STABILIZATION

INCORPORATION BY REFERENCE/RELATED APPLICATION

This application claims priority to Japanese Patent Application No. 2011-203885 filed on Sep. 17, 2011 the disclosure of which, including the specification, drawings and abstract, is incorporated herein by reference in its entirety.

BACKGROUND OF THE INVENTION

1. Field of the Invention

The invention relates to an electric oil pump.

2. Discussion of Background

There is a conventional electric oil pump that is formed by combining a pump with an electric motor that drives the pump. The electric motor includes a rotor that rotates and a stator that is fixed arranged radially outward of the rotor. The rotor is formed by arranging a plurality of permanent magnets on the outer periphery of a rotary drive shaft in the circumferential direction. The rotary drive shaft is shared by the electric motor and the pump. Japanese Patent Application Publication No. 2005-98268 (JP 2005-98268 A) describes a pump in which a stator of an electric motor is fixed to a motor housing with bolts inserted from a pump housing.

However, when the stator of the electric motor is formed by integrally forming coils with bus bars connected to the coils through resin molding, if the pump and the electric motor are fastened to each other with bolts via a resin mold portion, the resin mold portion of the stator, which is in contact with a metal surface of the pump housing, may undergo so-called creep deformation due to, for example, secular change. Thus, deformation of a stator core and loosening of the bolts may occur, and, furthermore, contact noise of a rotor portion of the pump, undesirable operating noise of the electric oil pump due to pulsation of pump discharge pressure or a decrease in pump output may occur.

SUMMARY OF THE INVENTION

The invention provides an electric oil pump in which a discharge pressure of the pump is stabilized by preventing creep deformation of a resin mold portion of a stator of a motor.

According to a feature of an example of the invention, a housing of an oil pump and a stator of an electric motor are fastened to each other with a screw via a resin member to which a coil wound at a stator core of the electric motor and a wire connection member connected to the coil are integrally molded, and a retaining member that restricts fastening force between the housing of the oil pump and the stator of the electric motor is inserted in a through-hole formed in the resin member.

According to another feature of an example of the invention, the retaining member has an axial length that is longer than the through-hole formed in the resin member, and a plurality of the retaining members is arranged on the resin member at equal intervals in the circumferential direction.

BRIEF DESCRIPTION OF THE DRAWINGS

The foregoing and further objects, features and advantages of the invention will become apparent from the following description of example embodiment with reference to the accompanying drawings, wherein like numerals are used to represent like elements and wherein.

DETAILED DESCRIPTION OF EMBODIMENTS

Hereinafter, embodiments of the invention will be described with reference to the accompanying drawings.

Figure 1:
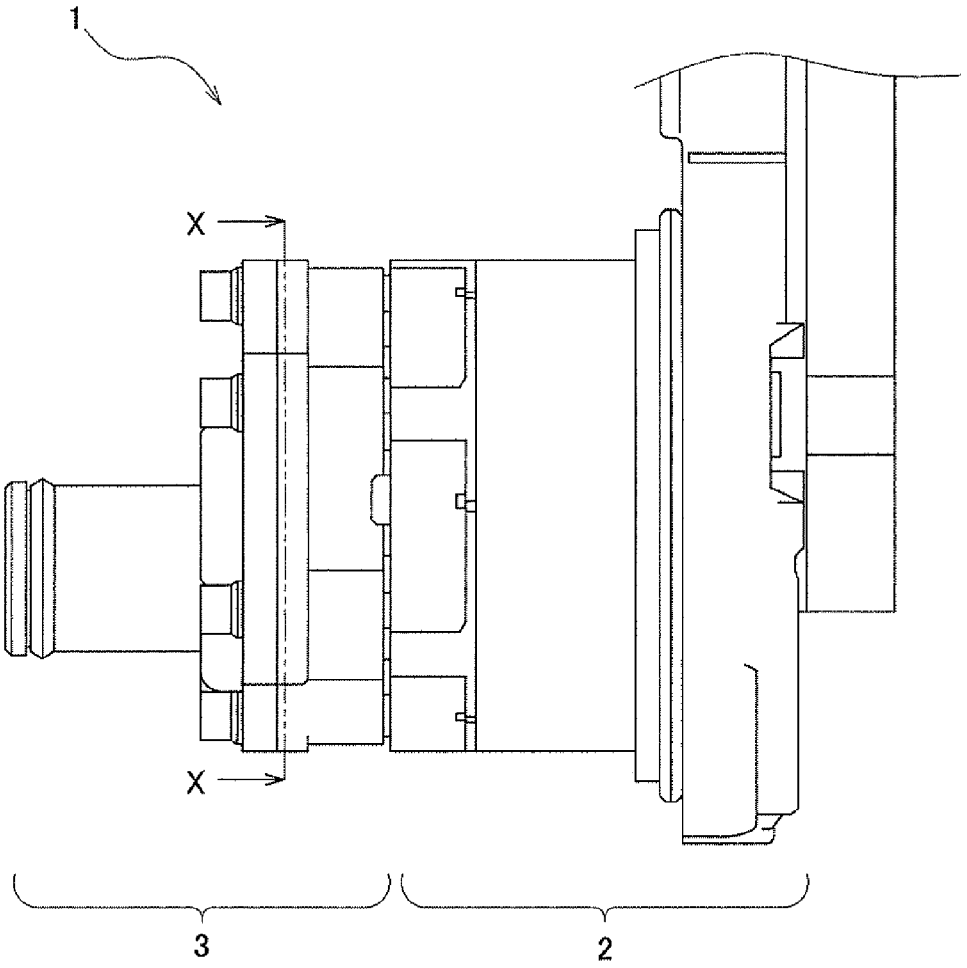
FIG. 1 is a side view that shows an electric oil pump according to an embodiment of the invention.

FIG. 1 is an axial side view that shows an electric oil pump 1 according to an embodiment of the invention. As shown in FIG. 1, the electric oil pump 1 is used as a hydraulic pump for a transmission of an automobile, and is formed by combining an electric motor 2 and a gear pump (oil pump) 3 with each other. The electric motor 2 shown in FIG. 1 is a three-phase brushless motor, and the U-phase, V-phase and W-phase of the electric motor 12 are formed of three sets of coils.

Figure 2:
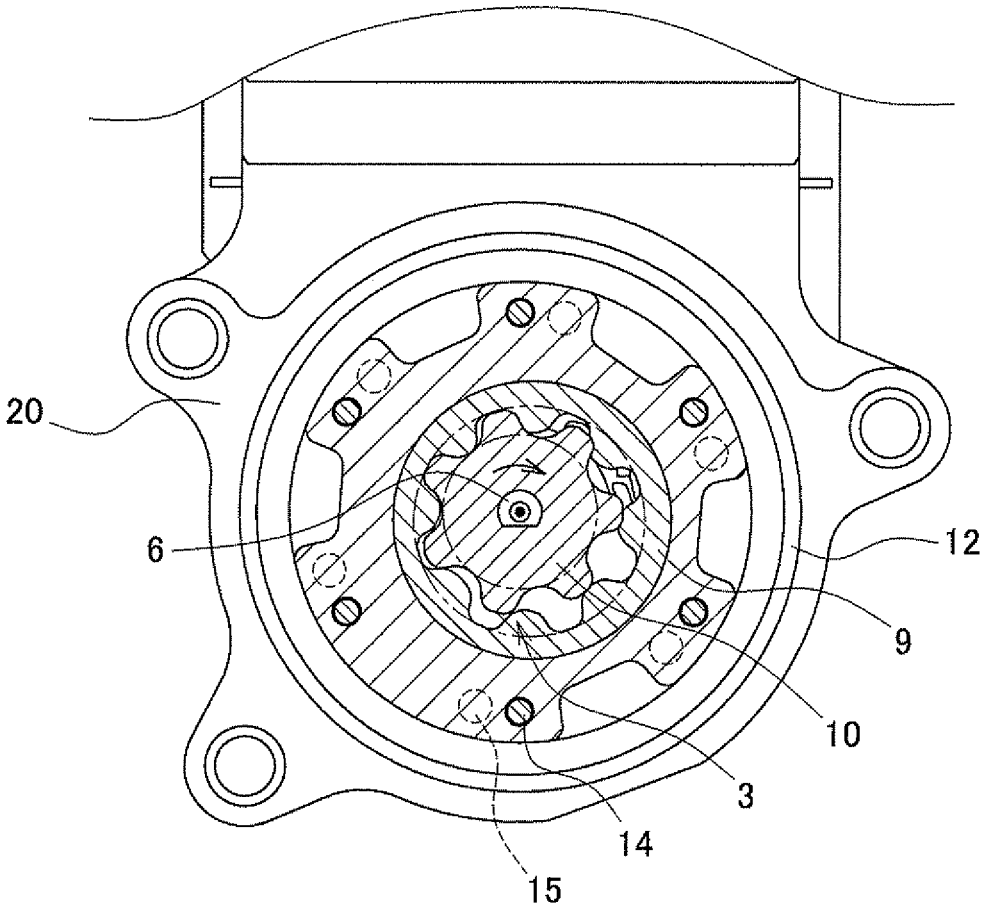
FIG. 2 is a sectional view of a rotor portion of the oil pump, taken along the line X-X in FIG. 1.

FIG. 2 is a sectional view taken along the line X-X in FIG. 1, and shows a rotor portion of the gear pump 3. As shown in FIG. 2, the gear pump 3 is a trochoid pump. The gear pump 3 is formed by meshing a pump inner rotor 10 having external teeth with the inner peripheral-side portion of a pump outer rotor 9 having internal teeth formed in a trochoid tooth profile, and arranging the outer rotor 9 and the inner rotor 10 in a pump housing 12 eccentrically and rotatably.

The inner rotor 10 is fixed to the distal end of a rotary drive shaft 6, and rotates together with the rotary drive shaft 6. The outer rotor 9 has internal teeth of which the number is larger by one than the number of the external teeth of the inner rotor 10. The outer rotor 9 is arranged inside the pump housing 12 so as to be rotatable about a position that is offset from the axis of the rotary drive shaft 6. In addition, the inner rotor 10 rotates with some of the external teeth in mesh with some of the internal teeth of the outer rotor 9 and the other external teeth substantially in contact with the top lands of the other internal teeth of the outer rotor 9.

Therefore, when the rotary drive shaft 6 is rotated by the electric motor 2, the volumes of gaps between the outer rotor 9 and the inner rotor 10 of the gear pump 3 are repeatedly increased and decreased during one rotation of the rotary drive shaft 6. Therefore, pumping action that delivers oil from an inlet port (not shown) to an outlet port (not shown) is performed. The inlet port and the outlet port are in communication with these gaps.

Figure 3:
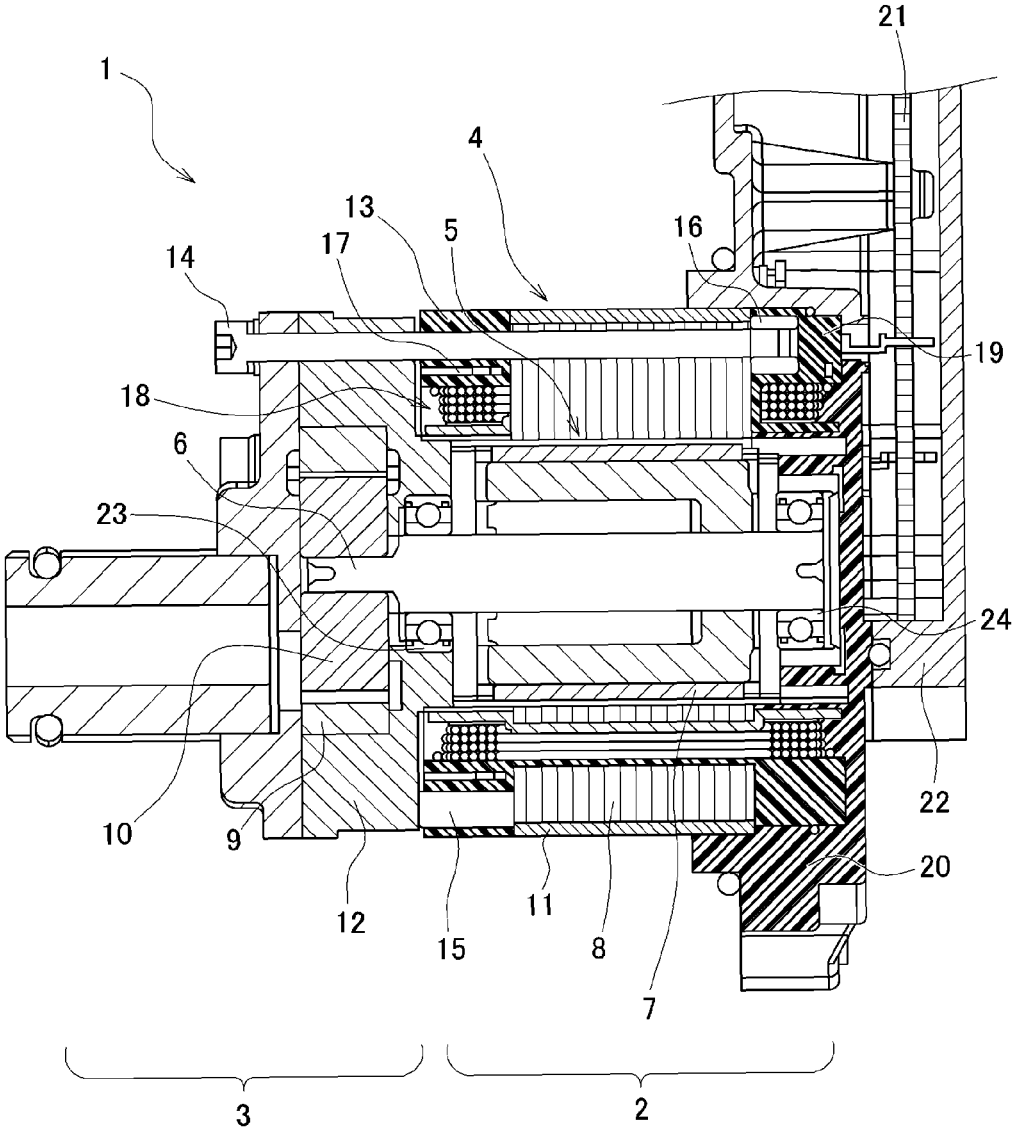
FIG. 3 is a partial sectional view that shows the axial sectional configuration of the electric oil pump according to the embodiment of the invention.

FIG. 3 is a partial sectional view that shows the axial sectional configuration of the electric oil pump according to the embodiment of the invention. As shown in FIG. 3, the electric motor 2 includes a motor rotor 5 that rotates and a motor stator 4 that is fixedly arranged radially outward of the outer periphery of the rotor 5. The rotor 5 is formed by, for example, arranging a plurality of permanent magnets 7 on the outer periphery of the rotary drive shaft 6 in the circumferential direction. The rotary drive shaft 6 is shared by the electric motor 2 and the gear pump 3. End portions of the rotary drive shaft 6 are rotatably supported by bearings 23 and 24 inside the pump housing 12 and a body case 20, respectively.

The stator 4 has a stator core 8 having a plurality of inward teeth that extend radially inward. The inward teeth are arranged radially outward of the outer periphery of the rotor 5 with a slight air gap. The number of the teeth is six in the present embodiment. A coil 18 is wound around each of the teeth of the stator core 8. Insulators for insulating the coils 18 from the stator core 8 are attached to respective axial ends of the stator core 8. Note that, for the sake of convenience, an insulator located between the gear pump 3 and the stator 4 is referred to as a front insulator (resin member) 13, and an insulator on the opposite side of the stator 4 from the front insulator 13 is referred to as a rear insulator 19.

The pump housing 12 and a motor housing 11 are made of a nonmagnetic material. The front insulator 13 and the rear insulator 19 are made of a resin material. A housing body is formed of the pump housing 12, the front insulator 13, the motor housing 11 and the body case 20.

The coils 18 are wound around the teeth of the stator core 8 and a ring-shaped bus bar 17 having bus bar terminals that electrically connect the coils 18 to one another are integrally molded to the front insulator 13. A plurality of (for example, six) bus bar terminals are formed in the bus bar 17. Each bus bar terminal has a slit that is open at one end. End portions of the coils 18 are engaged with the bus bar terminals, and the engaged portions are welded by fusing.

In addition, a bus bar (not shown) that has bus bar terminals for electrically connecting the coils 18 to one another or the coils 18 to a control board 21 (described later) is arranged in the rear insulator 19 provided on the stator core 8, and six metal nuts 16 are embedded in the rear insulator 19 through insert molding. Then, by screwing bolts 14, inserted from the pump housing 12, into the nuts 16 embedded in the rear insulator 19, the stator 4 of the electric motor 2 is fixed. The six bolts 14 are arranged at equal intervals in the circumferential direction around the central axis (see FIG. 2).

Columnar metal dowel pins 15, which may function as retaining members, are fitted into six through-holes formed in the front insulator 13 so as to be arranged in the circumferential direction and so as to be located next to insertion holes for the bolts 14 (see FIG. 2). Respective ends of each dowel pin 15 has tapered portions having narrow distal end portions, and are in contact with a bottom face of the pump housing 12 and a pump-side surface of the stator core 8. The axial length of each dowel pin 15 is longer than the axial height (through-hole length) of the front insulator 13. Therefore, the pump housing 12 and the front insulator 13 are fixed to each other with a slight gap formed therebetween.

In the electric oil pump 1 according to the present embodiment, the control board 21 for controlling the electric motor 2 is attached to the resin body case 20 from the outer end face side of the body case 20. An inverter circuit and a control circuit are mounted on the control board 21. The inverter circuit converts direct-current from a power supply to alternating-current, and supplies driving current to each of the coils 18 of the electric motor 2. The control circuit controls the inverter circuit on the basis of information on a rotation position of the outer rotor 9, which is detected by a sensor, such as a Hall element. The control board 21 is hermetically accommodated in a control board housing 22, which is made of a metal having a high thermal conductivity, together with electronic components, such as coils and capacitors (not shown), on the circuit board. These members constitute a controller of the electric oil pump 1. The control board 21 and the electronic components are hermetically accommodated in the control board housing 22. Thus, the waterproof property of the control circuit is ensured.

With the above-described configuration, driving current controlled by the control board 21 is supplied to the coils 18 via the bus bar terminals of the rear insulator 19. Thus, a rotating magnetic field is generated in each coil 18, torque occurs in the permanent magnets 7, and the rotor 4 is rotated. When the inner rotor 10 is rotated in this way, the outer rotor 9 is rotated in accordance with the rotation of the inner rotor 10, and gaps between the internal teeth of the outer rotor 9 and the external teeth of the inner rotor 10 are repeatedly increased and decreased. In this way, pumping action for sucking in and discharging oil via the inlet port (not shown) and the outlet port (not shown) is performed.

Next, the operation and advantageous effects of the thus configured electric oil pump 1 according to the present embodiment will be described.

With the above-described configuration, the pump housing 12 of the gear pump 3 and the stator 4 of the electric motor 2 are fastened to each other with the six bolts 14 via the front insulator 13 to which the coils 18, wound around the teeth of the stator core 8 of the electric motor 2, and the bus bar 17, which connects the coils 18 to each other, are molded. The dowel pins 15 that restrict fastening force of the bolts 14 are inserted in the through-holes formed in the front insulator 13 at positions next to the insertion holes for the bolts 14. The six dowel pins 15, of which the number is equal to the number of the bolts 14, are arranged at equal intervals in the circumferential direction around the rotation center of the front insulator 13. At this time, the axial length of each dowel pin 15 is formed so as to be longer than the axial height (through-hole length) of the front insulator 13.

Thus, it is possible to prevent the front insulator 13 from undergoing so-called creep deformation due to, for example, secular change by the fastening force of the bolts 14. In addition, by fitting the dowel pins 15, gaps due to deformation of the front insulator 13 no longer occur. Therefore, deformation of the stator core 8 does not occur, and loosening of the bolts 14 does not occur, either. Furthermore, the dowel pins 15 are provided in the front insulator 13 at equal intervals. Therefore, it is possible to prevent the fastening force of the bolts 14 from nonuniformly acting on the front insulator 13, and it is possible to protect the inside of the resin mold of the front insulator 13 against deformation or damage caused by uneven fastening force.

As a result, contact noise between the outer rotor 9 and inner rotor 10 of the gear pump 3 and pulsation of discharge pressure are reduced, and undesirable operating noise of the electric oil pump 1 and a decrease in pump output are suppressed. In addition, it is possible to ensure a gap between the pump housing 12 and the front insulator 13 due to the dowel pins 15. Therefore, suction and discharging of oil are reliably performed. Furthermore, because oil sealing performance improves, it is possible to prevent a decrease in the output (pressure and flow rate of the oil discharged) from the gear pump 3. Furthermore, because axial vibration and circumferential rotation of the stator core 8, caused by the rotation of the rotor 5, are prevented, it is also possible to reduce a transmission loss of the driving force of the electric motor 2 to the gear pump 3.

As described above, according to the present embodiment, it is possible to provide the electric oil pump in which creep deformation of the resin mold portion of the stator of the motor is prevented, vibration of the motor and operating noise of the pump are suppressed, and the discharge pressure of the pump is stabilized.

The embodiment according to the invention is described above. However, the invention may be implemented in various other embodiments.

In the above-described embodiment, the dowel pins 15 are provided in the front insulator 13 to restrict creep deformation of the contact face of the resin mold portion of the insulator. However, the configuration is not limited to this. Instead of the dowel pins 15, projections that extend from the stator 4 of the electric motor 2 may be formed or projections that extend from the pump housing 12 may be formed.

In addition, in the above-described embodiment, the six dowel pins 15 are arranged in the front insulator 13 at equal intervals. However, the configuration is not limited to this. As long as the fastening force of the bolts 14 is uniformly restricted, the number of the dowel pins 15 may be smaller (for example, the dowel pins 15 may be arranged at equal intervals of 120 degrees).

In the above-described embodiment, the gear pump is used as the oil pump. However, the configuration is not limited to this. A rotary pump that operates, for example, using vane driving may be used. Furthermore, the gear pump 3 is not limited to the above-described trochoid pump, as long as the gear pump 3 is a gear pump in which internal teeth are formed at the inner peripheral portion of the outer rotor 9 and the outer rotor 9 is rotated with the internal teeth of the outer rotor 9 in mesh with the external teeth of the inner rotor 10 and with the axis of the outer rotor 9 offset from the axis of the inner rotor 10, thereby causing the volumes of gaps, partitioned with portions at which the outer rotor 9 and the inner rotor 10 contact each other, to repeatedly increase and decrease. In addition, the internal teeth of the outer rotor 9 and the external teeth of the inner rotor 10 may have a shape like a projection.

In addition, in the above-described embodiment, the multiple permanent magnets 7 are fixedly arranged on the outer peripheral portion of the rotary drive shaft 6 to form the rotor 5 of the electric motor 2. Alternatively, a ring-shaped permanent magnet may be fixed.

What is claimed is:

1. An electric oil pump that includes:

an oil pump;

an electric motor that is axially spaced apart from the oil pump and that shares a rotary shaft with the oil pump, wherein a housing of the oil pump and a stator of the electric motor are fastened to each other with a screw inserted in an insertion hole formed in a resin member arranged between the oil pump and the electric motor, wherein the housing of the oil pump and the resin member are fixed to each other with a circumferential gap formed between them, wherein the circumferential gap extends axially from an axial end face of the housing of the oil pump;

a coil wound at a stator core of the electric motor and a wire connection member connected to the coil being integrally molded to the resin member; and a retaining member that restricts fastening force between the housing of the oil pump and the stator of the electric motor and that is inserted in a through-hole formed in the resin member, wherein the through-hole formed in the resin member is separate from the insertion hole formed in the resin member that receives the screw, and wherein both the insertion hole and the through-hole are formed next to each other in the resin member such that both the retaining member and the screw when inserted into the resin member are positioned next to each other.

2. The electric oil pump according to claim 1, wherein the retaining member has an axial length that is longer than the through-hole formed in the resin member.

3. The electric oil pump according to claim 1, wherein a plurality of the retaining members is arranged on the resin member at equal intervals in a circumferential direction of the rotary shaft.

4. The electric oil pump according to claim 1, wherein the retaining member comprises tapered portions having narrow distal end portions.

5. The electric oil pump according to claim 4, wherein the tapered portions are in contact with a bottom face of the housing of the oil pump.

6. The electric oil pump according to claim 1, wherein the insertion hole in the resin member and the through-hole in the resin member are located radially inward of the housing for the oil pump such that the retaining member and the screw when inserted into the resin member are radially inward of the housing for the oil pump.

7. The electric oil pump according to claim 1, wherein a number of the screws inserted into the insertion holes of the resin member is equal to a number of the retaining members inserted into through-holes of the resin member.

8. The electric oil pump according to claim 1, wherein the screw has an axial length greater than a sum of axial lengths of (i) the housing of the oil pump, (ii) the resin member, and (iii) the stator member.

9. The electric oil pump according to claim 1, wherein a distal end of the inserted screw is inserted into a nut embedded in a rear resin member thereby fixing the stator of the electric motor to the oil pump, wherein the rear resin member is disposed at an axial end face of the stator of the electric motor which is opposite of another axial end face of the stator at which the resin member is disposed.

10. The electric oil pump according to claim 1, wherein an opening for the insertion hole and an opening of the through-hole are formed at a same axial position and on an axial end face of the resin member which is nearest the oil pump.

11. An electric oil pump that includes:

an oil pump;

an electric motor that (i) is axially spaced apart from the oil pump and (ii) shares a rotary shaft with the oil pump, wherein a housing of the oil pump and a stator of the electric motor are fastened to each other with a screw inserted in an insertion hole formed in a resin member arranged between the oil pump and the electric motor, wherein the housing of the oil pump and the resin member are fixed to each other with a circumferential gap formed between them, wherein the circumferential gap extends axially from an axial end face of the housing of the oil pump;

a coil wound at a stator core of the electric motor and a wire connection member connected to the coil being integrally molded to the resin member; and a retaining member that restricts fastening force between the housing of the oil pump and the stator of the electric motor and that is inserted in a through-hole formed in the resin member.

12. An electric oil pump that includes:

an oil pump;

an electric motor that is axially spaced apart from the oil pump and that shares a rotary shaft with the oil pump, wherein a housing of the oil pump and a stator of the electric motor are fastened to each other with a screw inserted in an insertion hole formed in a resin member arranged between the oil pump and the electric motor;

a coil wound at a stator core of the electric motor and a wire connection member connected to the coil being integrally molded to the resin member; and a retaining member that restricts fastening force between the housing of the oil pump and the stator of the electric motor and that is inserted in a through-hole formed in the resin member, wherein the through-hole formed in the resin member is separate from the insertion hole formed in the resin member that receives the screw, wherein both the insertion hole and the through-hole are formed next to each other in the resin member such that both the retaining member and the screw when inserted into the resin member are positioned next to each other, wherein a distal end of the inserted screw is inserted into a nut embedded in a rear resin member thereby fixing the stator of the electric motor to the oil pump, and wherein the rear resin member is disposed at an axial end face of the stator of the electric motor which is opposite of another axial end face of the stator at which the resin member is disposed.

* * * * *